United States Patent [19]

Grahl

[11] Patent Number: 4,535,878

[45] Date of Patent: Aug. 20, 1985

[54] PILLOW-TOTE BAG DEVICE

[76] Inventor: Norma S. Grahl, 831 Cleveland St., Greenville, S.C. 29601

[21] Appl. No.: 653,087

[22] Filed: Sep. 21, 1984

[51] Int. Cl.[3] ..... A45C 9/00

[52] U.S. Cl. ..... 190/1; 190/2; 190/8; 383/4; 5/435

[58] Field of Search ..... 190/1, 2, 8, 107, 109; 383/4, 37, 38; 5/434, 435, 436, 437, 442, 417

[56] References Cited

U.S. PATENT DOCUMENTS

| | | | |
|---|---|---|---|
| 2,507,842 | 5/1950 | Waddill | 383/39 |
| 2,810,920 | 10/1957 | Carruth | 5/435 |
| 4,054,960 | 10/1977 | Pettit et al. | 5/435 |
| 4,101,994 | 7/1978 | Hoyt | 383/4 |
| 4,273,380 | 1/1981 | Silvestri | 5/417 |
| 4,466,516 | 8/1984 | Sicoli et al. | 383/4 |

FOREIGN PATENT DOCUMENTS

| | | | |
|---|---|---|---|
| 2949282 | 6/1981 | Fed. Rep. of Germany | 5/435 |
| 1199533 | 7/1970 | United Kingdom | 5/435 |

*Primary Examiner*—George E. Lowrance
*Assistant Examiner*—David Fidei
*Attorney, Agent, or Firm*—Cort Flint

[57] ABSTRACT

A pillow-tote bag (A) is illustrated for use at the lake or beach for carrying accessory devices and for providing a face and head rest for a person either in a prone or a supine position. The bag device (A) includes a pillow panel (10) and a pocket panel (12). The pillow panel (10) advantageously includes a bifurcated pillow (B) having a first pillow cushion (20) and a second pillow cushion (22). The pillow cushions are bifurcated for access to an air mask (36) so that a person may breathe comfortably in a supine position. The bifurcated pillows may be joined together and the air mask closed to provide a cradle (48) and unitary pillows for supporting the head when a person is lying in a supine position. A spine member (16) maintains the bag device in a non-sagging configuration when used as a tote. Pockets (60) carried in the pocket panel (12) are maintained in a straight configuration due to the non-sagging configuration of the bag.

17 Claims, 6 Drawing Figures

Fig. 1.
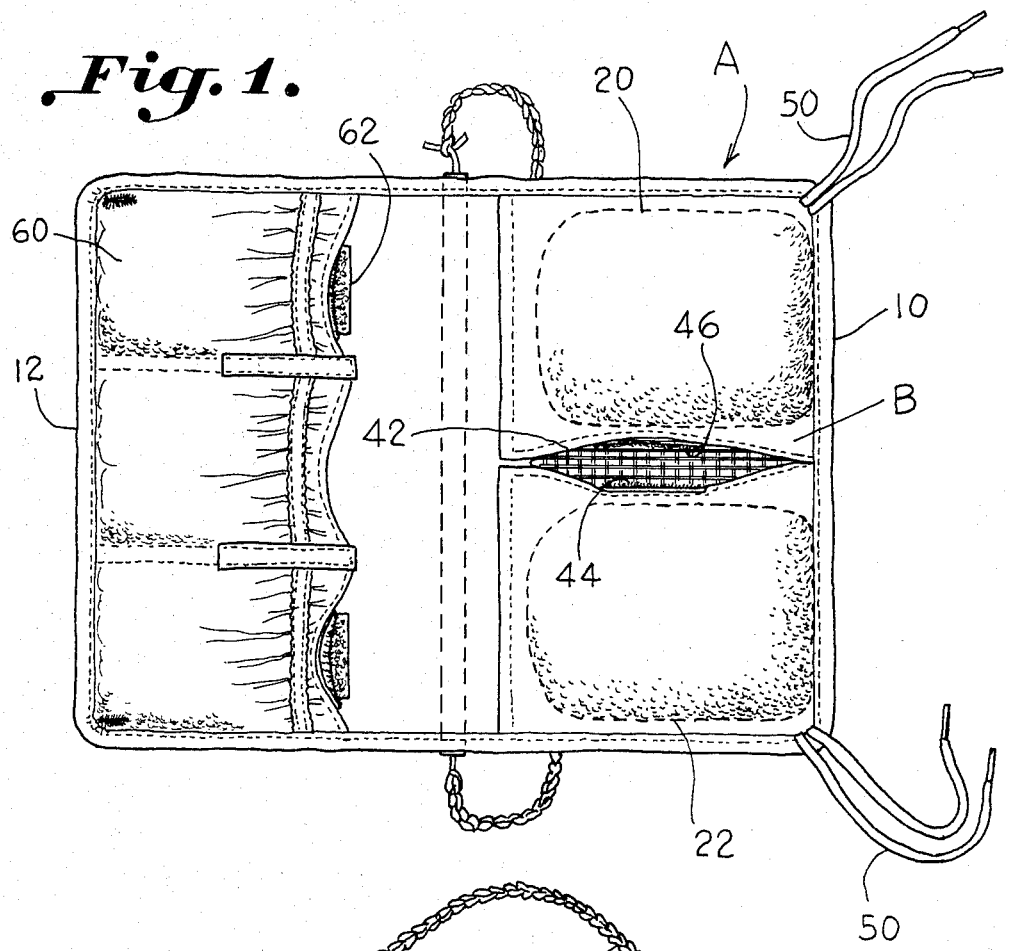
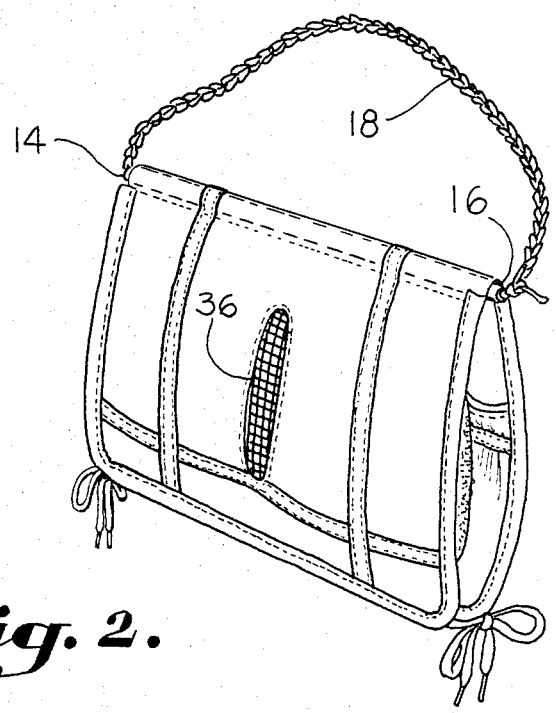
Fig. 2.

Fig. 4.
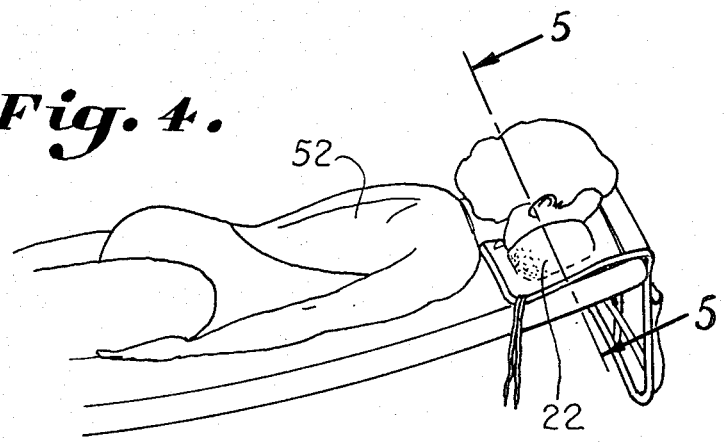
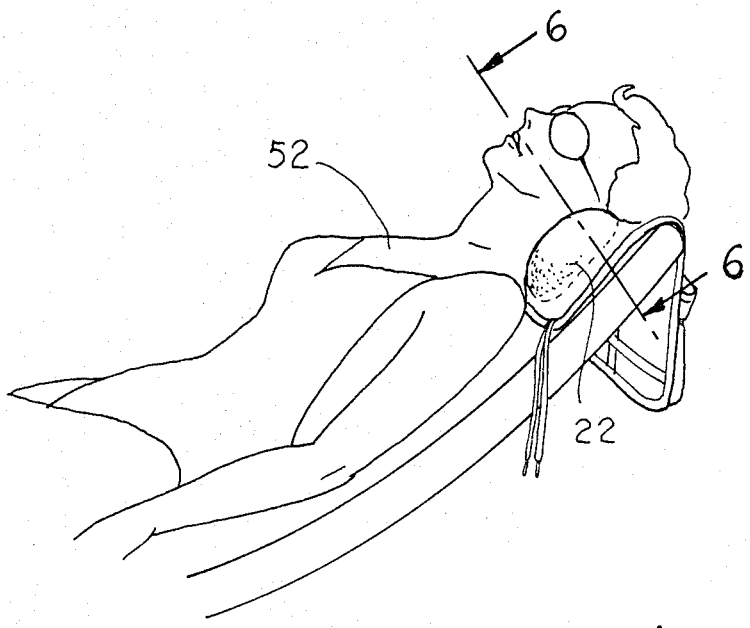
Fig. 5.

PILLOW-TOTE BAG DEVICE

BACKGROUND OF THE INVENTION

The invention relates to an accessory device which may be utilized outdoors such as at the lake or the beach for carrying accessories which are used in lying in the sun, swimming, or other outdoor activities. Advantageously, the device is directed to those types of devices which may be utilized as a pillow, as well as for toting accessory devices and which may be used advantageously as a facial pillow in either a supine or a prone position.

Heretofore, tote devices have been proposed such as that shown in U.S. Pat. No. 4,273,380 which provide a device which is easily attachable to a chair and a tote in which accessories may be carried and contained. However, the use of the device as a pillow is limited and particularly in a prone position the device does not provide a satisfactory facial pillow for a person. While pillow devices have generally been known to support a person in a prone position, such as that shown in U.S. Pat. No. 2,810,920 and U.S. Pat. No. D. 216,013, the satisfactory combination of such a device in a tote bag form to be additionally utilized to carry accessories has not been heretofore provided.

Accordingly, an important object of the present invention is to provide a pillow-tote bag device which can be utilized for supporting the head of a person in either a prone (face down) or a supine (face up) lying position.

Another important object of the present invention is to provide a combined pillow and tote bag device which can be advantageously used to carry accessory devices and which can be used at a final destination for a pillow device while lying outdoors.

Still another important object of the present invention is to provide a pillow-bag device having a bifurcated pillow which can comfortably support the back of a person's head when lying in a supine position and which can comfortably support the face of the person lying in a prone position while providing access to an air mask for breathing.

SUMMARY OF THE INVENTION

The above objectives are accomplished according to the present invention by providing a pillow and tote bag device having a pillow panel and a pocket panel. The pillow panel is advantageously constructed to have an air mask and a bifurcated pillow which may be bifurcated to support the face and to provide access to the air mask in a prone position. The bifurcated pillow may be closed to provide a unitary support for the back of the head when a person is lying in a supine position.

The pillow panel advantageously includes a pair of closure flaps over bifurcated cushions which form the bifurcated pillow. The closure flaps may be joined together at juxtaposed edges of the bifurcated pillows to provide a unitary pillow support and in particular to form a cradle for receiving the back of the head of a person in a supine position. The pocket panel includes a plurality of article containing and carrying pockets. The pocket panel and pillow panel are advantageously made integral with each other and are joined by a generally rigid spine member which provides a handle for the bag device and facilitates carrying of the bag device in a non-sagging configuration wherein the pockets are kept straight and the articles are contained therein.

DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a top plan view of a pillow-tote bag device constructed according to the present invention:

FIG. 2 is a perspective view illustrating a pillow-tote bag constructed according to the present invention with the device in a tote configuration;

FIG. 3 is a perspective view illustrating the pillow-tote bag device of the present invention when supporting the head of a person in a supine position;

FIG. 4 is a perspective view illustrating the pillow-tote bag device constructed according to the present invention when supporting the face of a person resting in a prone position.

DESCRIPTION OF A PREFERRED EMBODIMENT

Figure 5:
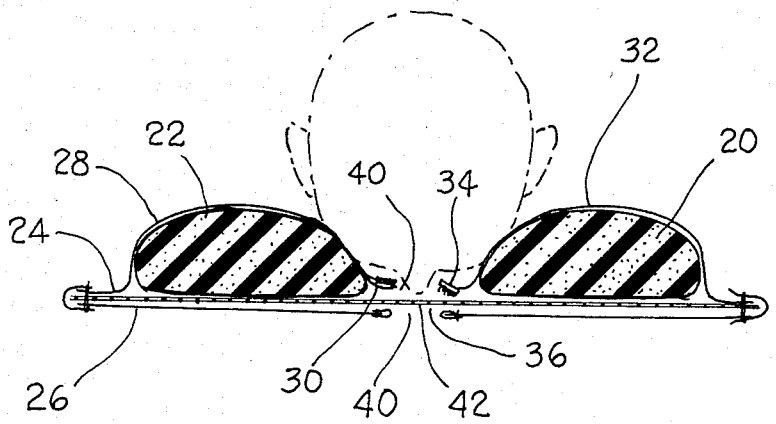
FIG. 5 is a sectional view of a pillow-tote bag constructed according to the present invention when a pillow panel of the device is supporting the face of a person in a prone position.

Referring now in more detail to the drawings, a pillow-tote bag device as illustrated generally as A which may be advantageously used for carrying accessories to the lake or beach and for lying in a lounge chair and the like while sunbathing and lying in a supine or a prone position.

As can best be seen in FIG. 1, the bag device A comprises a first pillow panel 10 and a second pocket panel 12. The two panels are integral with each other and a central casing 14 is made to join the panels together and is open for receiving a generally rigid spine member 16 which may be utilized to carry the bag in a non-sagging configuration. A flexible strap member 18 may be joined to the ends of the spine member to provide a handle for carrying the bag device.

It is preferred that the device be constructed of an absorbant toweling material. For this purpose the strap 18 may be removed from the spine member 16 which is illustrated in the form of a dowel so the dowel may be removed from the casing. The remaining portion of the bag device may then be laundered in a conventional washing machine.

Referring now in more detail to the pillow panel 10, a bifurcated pillow means is illustrated at B which generally includes a bifurcated pillow in the form of a first pillow cushion 10 and a second pillow cushion 22. The pillow panel 10 is formed of a two-ply material consisting of a first ply 24 and a second ply 26. The first pillow cushion 22 includes a covering 28 which terminates in a closure flap 30 at a first juxtaposed edge 31 of the bifurcated pillow means. The second pillow cushion 20 includes a covering 32 which terminates in a closure flap 34 at a second juxtaposed edge 35 of the bifurcated pillow means. Between the bifurcated pillow cushions and the juxtaposed edges thereof is an air mask 36.

The air mask 36 includes an air opening 40 formed in both the first and second plies of material forming the panel 10. Further, the air mask includes a piece of plastic mesh screen material 42 carried across the air openings 40 for protection. This means the face of the person is protected from whatever the pillow panel is lying upon when the face of the person is resting on the pillow panel. The mesh screen is preferably fastened to the edges of the air openings in the case of two plies or a single ply to maintain the formation of the opening(s).

The closure flaps 30 and 34 carry a closure means 44 and 46 at the juxtaposed edges 31 and 35. The closure means are preferably in the form of Velcro fastening tapes. One of the tapes is a hook tape, and one of the tapes is a fabric tape so that they lock together in a conventional manner.

Figure 6:
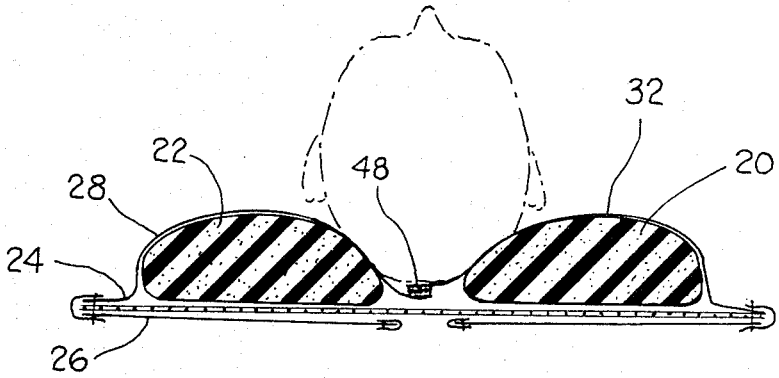
FIG. 6 is a sectional view of a pillow panel of a pillow-tote bag constructed according to the present invention supporting the back of the head of a person resting in a supine position.

As can readily be seen in reference to FIGS. 5 and 6, when the closure flaps of the bifuracted pillow are unfastened, the pillow cushions 22 and 20 are bifurcated for supporting the face of a person in a prone position with the cheeks of a person resting firmly on the side edges of the pillow cushions. In this position the juxtaposed edges are separated for full access to the air mask so that comfortable breathing is provided. On the other hand, should the person decide to lie in a supine position, the closure flaps 30 and 34 are joined and closed by means of the closure fastening tapes 44 and 46. As can best be seen in FIG. 6, this provides a cradle sling which receives the back of the head of the person. The cushions 20 and 22 are urged together, and separation by a supported head is effectively resisted. A single unbifurcated pillow means is provided by this so that a comfortable unitary support for the head is had on the pillow panel. Cushioning of the head is had against the pillow cushions as well as reception by the cradle sling which is formed by the closure flaps joined together in the unbifurcated position.

Means for attaching the bag device to a lounge chair or other similar furniture is illustrated in the form of stringing 50. The stringing also provides a means for joining the pillow and pocket panels together when carrying the device in the form of a tote, as can best be seen in FIG. 2. When the device is used in combination with a lounge chair, as can best be seen in FIGS. 3 and 4, the pillow panel is laid upon the back of the lounge chair and the pocket panel hangs downwardly. In this position a person 52 may be comfortably supported in a prone position for breathing or in a supine position, as can best be seen in FIGS. 5 and 6.

The plastic mesh screen material 42 is illustrated as a generally single plate of material which is carried between the two plies of the pillow panel. This provides a means for stiffening the entire pillow panel so that non-sagging of the pillow cushions occurs as well as providing a protective breathing cover. The screen plate is sewn with the edges of the panel. Other configurations may be had for the air mask, such as the mesh screen may be sewn into a single ply of material having an air opening. The mesh not only protects the person's face in serving as an air mask for breathing through the air opening but also serves to maintain the formation of the air opening where the toweling material is sewn onto the mesh screen.

The pocket panel 12 advantageously includes a plurality of pockets 60 for containing articles and carrying accessories to the beach or lake. Velcro fastening means 62 similar to that of the closure tapes 40 and 46 is provided for closing the pockets and retaining the articles therein. It can be seen that the spine member which forms a non-sagging bag also serves the important function of keeping the pockets straight and preventing the bag from sagging so that the articles contained therein are retained.

Thus it can be seen that an advantageous construction can be had for a pillow-tote bag device wherein a highly satisfactory pillow panel is provided having bifurcated pillows which provide access to an air mask for breathing as well as providing comfortable support when joined together to form a single pillow.

While a perferred embodiment of the invention has been described using specific terms, such description is for illustrative purposes only; and it is to be understood that changes and variations may be made without departing from the spirit or scope of the following claims.

What is claimed is:

1. A pillow-tote bag device for use as a pillow and a tote comprising:

a pillow panel;

a pocket panel integral with said pillow panel;

a central casing extending across a width of said panels;

a generally rigid spine member received in said casing to provide a non-sagging configuration for said bag device;

an air mask carried by said pillow panel including an air opening formed in said pillow panel for breathing;

bifurcated pillow means carried by said pillow panel generally overlying said air mask;

said bifurcated pillow means including two separable generally rectangular pillow cushions carried on adjacent sides of said air mask having juxtaposed edges which are separable to provide access to said air mask for breathing and being closable to cover said air mask;

closure means carried by said juxtaposed edges for closing said separable pillow cushions along a length of said edges to form a head cradle sling connecting said pillow cushions together and resisting separation thereof to provide a continuous unitary head support for supporting a back head portion of a person lying in a supine position; and said closure means being openable to separate said juxtaposed edges of said two pillow cushions along their length for providing access to said air mask when said person is lying in a prone position with his face supported on said bifurcated pillow means.

2. The device of claim 1 wherein said air mask includes a mash screen of a generally rigid material covering said air opening.

3. The device of claim 1 wherein said pillow panel is formed from a sheet of material, and said air mask includes an opening formed in said material and a mesh screen covering said opening in said material and maintaining said opening in said material in the form of an air opening for breathing through said pillow panel.

4. The device of claim 1 wherein said bifurcated pillow means includes a first closure flap carried over a first of said separated pillow cushions along a juxtaposed edge thereof, a second closure flap carried over a second of said separated pillow cushions along a juxtaposed edge thereof, and a closure fastener for closing and fastening said first and second closure flaps and said bifurcated pillow cushions together to provide said unitary head support.

5. The device of claim 4 wherein said closure flaps form a head receiving cradle sling over said air mask to cradle and receive said head to form said back head rest when said person is lying in said supine position on said pillow panel.

6. The device of claim 1 wherein said pocket panel includes a plurality of article containing pockets in which separable articles may be contained and fastening means for closing said pockets to prevent the accidental loss of said articles from said pockets.

7. The device of claim 6 including attachment means fixing said pillow panel to an associated piece of furniture, said attachment means serving to fasten said pocket and pillow panels together to form a tote bag when said device is not being used as a pillow.

8. The device of claim 1 including a strap fixed to the ends of said generally rigid spine member by which said bag device may be carried with said pillow panel and pocket panels maintained in a generally non-sagging configuration in the form of a generally rectangular bag.

9. The device of claim 1 wherein said closure means includes a first strip of Velcro fastening tape carried on one of said closure flaps and a second strip of Velcro fastening tape carried on the other of said closure flaps.

10. A pillow bag device comprising:

a pillow panel formed from a textile fabric;

a pair of bifurcated pillow cushions carried by said pillow panel;

an air mask carried by said pillow panel which includes an air opening formed in said panel and a mesh air mask screen carried across said opening to maintain said opening in an open condition for breathing through said panel, said bifurcated pillow cushions having juxtaposted edges being separable from one another for access to said air mask and breathing opening when a person is lying in a prone position with his face supported upon said pillow panel;

a first closure flap carried by a first of said pillow cushions along a juxtaposed edge of said first pillow cushion and a second closure flap carried by a second of said pillow cushions along a juxtaposed edge of said second pillow cushion;

closure means for joining together said closure flaps and juxtaposed of said pillow cushions to close said bifurcated pillow cushions and join said pillow cushions together; and said closure flaps joining and fastening together to form a head receiving cradle and resist separation of said bifurcated pillow cushions to provide a unitary head support for the head of a person lying in a supine position.

11. The pillow bag device of claim 10 including a second panel secured integrally with said pillow panel and a generally rigid spine member carried between said panels to maintain said panels in a regular panel configuration and to form a generally non-sagging bag device.

12. The device of claim 10 wherein said pillow panel is formed from an absorbent toweling material.

13. The device of claim 11 wherein said second panel includes a plurality of pockets, a handle means carried by said spine member for carrying said bag device and said spine member being generally rigid so that said bag device is carried in a non-sagging configuration with said pockets held generally straight so that articles contained therein are prevented from falling out.

14. A pillow-tote bag device for use as a pollow and a tote comprising:

a generally regular pillow panel comprising a ply of material;

an air permeable mask formed in said ply of material forming an air opening for breathing through said panel;

bifurcated pillow means carried by said pillow panel including first and second juxtaposed edges having an open position in which the face of a person is supported by said bifurcated pillow means with free access for breathing through said air mask when lying in a prone position;

said bifurcated pillow means having a closed position in which said juxtaposed edges of said bifurcated pillow means covers said air mask and assist in supporting the head of a person lying in a supine position;

closure means carried by said bifurcated pillow means facilitating opening of said bifurcated pillow means in said open position and closing and fastening of said juxtaposed edges in said closed position.

15. The device of claim 14 wherein said closure means includes a pair of flap closures carried by said bifurcated pillow means which include a closure fastener carried on adjacent opposing juxtaposed edges of said closure flaps which opens said flaps to provide said bifurcated pillow means and access to said air mask and closes said flaps to assist in providing said unitary head support in the form of a head cradle sling.

16. The device in claim 14 wherein said pillow panel is formed of a two-ply construction having a first ply of material and a second ply of material, an air hole formed in said first and second plies of material, and said air mask includes a generally rigid mesh plate carried between said plies of material in said pillow panel assisting in the formation of said openings.

17. The device in claim 15 wherein said bifurcated pillow means includes two separable pillow cushions which support the cheeks of a person's face while he is lying in a prone position, said closure flaps being closed by said closure fasteners to resist separation of said cushions and form a head supporting cradle between said two pillow cushions facilitating support of said head when lying in a supine position.

* * * * *